US005561019A

United States Patent [19]

Yuasa et al.

[11] Patent Number: 5,561,019

[45] Date of Patent: Oct. 1, 1996

[54] MAGNETIC TONER

[75] Inventors: Yasuhito Yuasa, Hirakata; Noriaki Hirota, Suita; Akinori Toyoda, Katano; Hideki Tatematsu, Ashiya, all of Japan

[73] Assignee: Matsushita Electric Industrial Co., Ltd., Osaka, Japan

[21] Appl. No.: 419,988

[22] Filed: Apr. 11, 1995

[30] Foreign Application Priority Data

| | | | |
|---|---|---|---|
| Apr. 22, 1994 | [JP] | Japan | 6-084529 |
| May 13, 1994 | [JP] | Japan | 6-099622 |
| May 13, 1994 | [JP] | Japan | 6-099623 |
| May 18, 1994 | [JP] | Japan | 6-103726 |
| May 18, 1994 | [JP] | Japan | 6-103727 |
| Nov. 18, 1994 | [JP] | Japan | 6-284856 |

[51] Int. Cl.[6] ..... G03G 9/083

[52] U.S. Cl. ..... 430/106.6; 430/182

[58] Field of Search ..... 430/106.6, 126, 430/122; 355/245

[56] References Cited

U.S. PATENT DOCUMENTS

| | | | |
|---|---|---|---|
| 5,215,845 | 6/1993 | Yusa et al. | 430/106.6 |
| 5,307,122 | 4/1994 | Ohno et al. | 355/245 |
| 5,364,720 | 11/1994 | Nakazawa et al. | 430/106.6 |
| 5,364,730 | 11/1994 | Kojima et al. | 430/137 |
| 5,370,961 | 12/1994 | Zaretsky et al. | 430/126 |

FOREIGN PATENT DOCUMENTS

| | | |
|---|---|---|
| 0581257 | 2/1985 | European Pat. Off. . |
| 0223594 | 5/1987 | European Pat. Off. . |
| 0395026 | 10/1990 | European Pat. Off. . |
| 0427275 | 5/1991 | European Pat. Off. . |
| 0488789 | 6/1992 | European Pat. Off. . |
| 0541113 | 5/1993 | European Pat. Off. . |
| 3428433 | 2/1985 | Germany . |
| 60-32060 | 2/1985 | Japan . |
| 61-249059 | 11/1986 | Japan . |
| 2-287459 | 11/1990 | Japan . |
| 4-162048 | 6/1992 | Japan . |

*Primary Examiner*—John L. Goodrow
*Attorney, Agent, or Firm*—Fish & Richardson PC

[57] ABSTRACT

Magnetic toner used for electrophotographic development includes additives such as inorganic fine particles, having a particular particle diameter and specific surface area, and hydrophobic silica having a particular specific surface area and surface treatment, so that the magnetic toner can provide images of high quality without generating photoconductor filming. The magnetic toner is applied to the electrophotographic method including the developing step of forming electrostatic latent images on a photoconductor containing a stationary magnet, magnetically attracting the magnetic toner to the surface of the photoconductor in a toner sump, and collecting toner at a non-image section by an electrode roller; the transferring step of transferring the toner to transfer paper; the cleaning step of removing residual magnetic toner left on the photoconductor in the transferring step; and the recycling step of recycling the residual magnetic toner.

31 Claims, 3 Drawing Sheets

MAGNETIC TONER

FIELD OF THE INVENTION

The invention relates to magnetic toner which is used for copying machines, printers and facsimiles.

BACKGROUND OF THE INVENTION

Conventional methods for developing electrostatic latent images by an electrophotographic method include the cascade phenomenon method, the touch down method, and the jumping method, etc. The cascade developing method disclosed in U.S. Pat. No. 3,105,770 involves sprinkling developing powder directly on a photoconductor. The cascade developing method was the first electrophotographic method applied to copying machines for practical use. Also, U.S. Pat. No. 3,866,574 discloses the developing method of stirring up one component toner by applying a.c. bias to a developing roller. In this method, the a.c. bias is applied so as to activate the movement of the toner, so that the toner is stirred up at image areas and returned at non-image areas on the photoconductor.

The method which improved the technique of applying the a.c. bias is the jumping developing method disclosed in Published Examined (Kokoku) Japanese Patent Application No. Sho 63-42256. In this method, the toner is supported by a toner support member, and on the toner support member there is provided a doctor blade for regulation of a rigid body or elastic body at a minute spacing to the support member. The toner is regulated into a thin layer by the doctor blade and transferred to a developing section, where the toner is deposited on the image areas of the photoconductor with the a.c. bias application. This method is different from the one disclosed in the above-mentioned U.S. Pat. No. 3,866,574 since the toner in the former method moves reciprocatingly between the image section and the non-image section.

It is well known that toner used for electrostatic developing methods including the methods mentioned above generally consists of resin, a coloring component such as pigment and dye, and an additive such as plasticizer and a charge control agent. As resin, natural or synthetic resin, or the combination of both is used.

The cascade developing method is poor in reproducing solid images. The method also requires an extremely large and complicated device. Moreover, the developing device disclosed in U.S. Pat. No. 3,866,574 requires high precision, and is complicated and costly. In the jumping developing method, a thin layer of the toner on a toner support member at a uniform thickness must always be formed. In addition, a previous image remains on the toner thin film, thus a residual image appears on an image in this method (sleeve ghost). There is also a problem in that the device used in this method is complicated and costly.

In order to solve these problems, an electrophotographic method disclosed in Published Unexamined (Kokai) Japanese Patent Application No. Hei 5-72890 was proposed. The device used in this method consists of a photoconductor containing a stationary magnet and an electrode roller having a magnet. The electrode roller faces the photoconductor with a predetermined gap in between. Thus, in this method, solid images are steadily reproduced and sleeve ghosts are not generated. Also, the device is further miniaturized and simplified, thus lowering the cost.

However, in order to improve the quality of images with this method, toner is required to be high in quality. In this method, since the doctor blade is not used, the toner is carried to a developing field between the photoconductor and the electrode roller without being controlled to a thin layer. Therefore, there is little space for the toner to be tribo-charged and to obtain tribo-charge amount, and the toner is required to have high chargeable properties and fluidity.

With a conventional toner which is used for a one-component developing method or a two-component developing method, images become uneven and fog in non-image sections increases. This is because the toner has low fluidity. A preferable level of tribo-charge cannot be obtained from a toner having low fluidity since the rate of contact with a developing member is low. Also, the tribo-charge becomes uneven within the toner, so the chargeable properties of the toner become uneven.

In order to increase the fluidity of toner, a method of adding silica, etc. as an additive is disclosed in Published Examined (Kokoku) Japanese Patent Application No. Sho 54-16219, and a method of using hydrophobic silica fine powder is disclosed in Published Unexamined (Kokai) Japanese Patent Applications No. Sho 46-5782, No. Sho 48-47345 and No. Sho 48-47346. For example, hydrophobic silica fine powder is prepared by reacting silica fine powder and an organic silicon compound such as dimethyl dichlorosilane, and replacing silanol groups on the surface of silica fine powder with organic groups. Although the fluidity of toner increases due to the additive, silica fine particles are likely to aggregate with each other. As a result, the suspended matter of silica increases, and a photoconductor will be scratched by the suspended matter. Residual films from the silica and toner are also generated on the photoconductor.

When using magnetic toner in which magnetic particles are contained as an internal additive, the particles are exposed after magnetic toner materials are pulverized. Thus, the toner will scratch a photoconductor, thus generating a film. With the film formed on a photoconductor, the surface potential of the photoconductor is not likely to decline when a charged photoconductor is exposed to light. As a result, in a reverse development, image defects such as the formation of white sections in a black image are found. White point noise is also generated since the suspended matter of silica adheres to a black image section. Thus, the addition of silica fine powder provides the above-noted additional problems.

In the electrophotographic method to which the magnetic toner of the invention is applied, the toner is first sprinkled over the entire surface of a photoconductor, and then developed. Therefore, compared with other conventional methods, toner is in contact with the photoconductor for a long time. As a result, toner film is likely to generate.

In order to prevent such a film, a friction reducing material such as polyvinylidene fluoride powder is disclosed in Published Examined (Kokoku) Japanese Patent Applications No. Sho 48-8136, No. Sho 48-8141 and No. Sho 51-1130.

Furthermore, Published Unexamined (Kokai) Japanese Patent Application No. Sho 48-47345 discloses the addition of a friction reducing material and an abrasive material in magnetic toner. Even though the addition is effective for eliminating toner film, paper dust, which adheres to a photoconductor surface due to repeated use, and low electrical resistance materials such as ozone products cannot be removed. The electrostatic latent image of the photoconductor thus is heavily damaged particularly in high temperature and humidity.

Published Unexamined (Kokai) Japanese Patent Applications No. Sho 60-32060 and No. Sho 59-219754 disclose the addition of titanate-based fine powder to toner as a second additive. The powder is mechanically pulverized, and the particle shape of the powder is irregular. Although the powder can be used to remove foreign matter on a photoconductor, protruding sections of the particles harm the photoconductor, thus distorting images. Moreover, in the electrophotographic method to which the magnetic toner of the invention is applied, toner is in contact with the entire surface of a photoconductor. Thus, when the titanate fine powder is simply added and copies with low black area ratios are taken, only the powder in the toner is consumed and used up in the long term, thus eliminating the ability of the toner to resist filming.

Also, in the method, a transferring roller is in contact with a photoconductor. Therefore, the abrasive material, friction-reducing material, etc. are transferred to the roller and are not supplied to a cleaning blade if the abrasive material, friction-reducing material, etc. are simply added to the toner. As a result, film cannot be prevented.

Thus merely adding other abrasive materials such as alumina and titania to magnetic toner provides a negative effect on the chargeable properties of the toner. As a result, image density is reduced, and fog increases.

Environmental protection has recently been an issue of great concern. In conventional copying machines, laser printers, laser plain paper facsimiles, etc., toner is developed on a photoconductor in the developing step, and the toner is then transferred to paper in a transferring step. Some of the toner remains on the photoconductor, and that toner is removed in a cleaning step. The cleaned toner, however, is residual toner. In conventional methods, particularly in the one-component developing method, the residual toner is not recycled.

A problem with recycling the residual toner is that the fluidity of the toner declines due to the stress received in a developing field, thus fluctuating charge amount. The residual toner with reduced fluidity aggregates and clogs up a doctor blade. When the residual toner of a conventional magnetic toner is recycled and mixed with new toner in a developing device, the charging amount distribution of the toner becomes uneven, and wrong sign toner.

Also, in order to recycle the residual toner for development, the toner has to be useful for a long period. In particular, the ability of the toner to resist against filming needs to be increased from the conventional level. Thus, improved dispersion of additives in the toner, reduced aggregation of the toner, and even adherence of the toner should be satisfied.

In the electrophotographic method to which the magnetic toner of the invention is applied, a conductive elastic roller is used. When a roller and conventional toner are used, letters and lines are transferred without the transfer of their internal image sections. Also, the toner is scattered around the letters and lines.

When conventional magnetic toner is transferred to transfer paper by a transfer roller, the roller is in contact with a photoconductor with predetermined stress. Compared with sections where there is no toner, a lot of toner is deposited at sections where the toner is concentrated and the stress increases. As a result, the toner aggregates due to high stress, and is not transferred to the transfer paper. Therefore, letters and lines are transferred without the transfer of internal image sections (hollow characters). The toner on a photoconductor is transferred to transfer paper by the relation among the charge potential of toner, the opposite charge potential of roller added from outside. Therefore, when the potential of the toner is low, the toner scatters on the empty space of paper around the letters and lines.

When conventional magnetic toner is used, the toner is not recycled. Thus, natural resources are not effectively used, and the environment is harmed.

SUMMARY OF THE INVENTION

It is an object of the invention to solve the above-noted conventional problems by providing magnetic toner, which has high chargeable properties and fluidity and can provide high image density and image quality, in a developing method which further reduces the size, complexity and cost of a developing device and which recycles its toner.

It is another object of the invention to provide magnetic toner which can prevent hollow characters (which are transferred without affecting the internal area) and scattered transfer in a low ozone treatment by using roller transfer.

It is also an object of the invention to provide magnetic toner which can prevent photoconductor film during long-term use.

Furthermore, it is an object of the invention to provide magnetic toner which does not reduce the charge amount and fluidity of the toner and does not generate aggregating objects even if residual toner is recycled, thus recycling natural resources.

In order to accomplish these and other objects and advantages, the magnetic toner of the invention comprises magnetic toner base particles comprising at least binder resin and magnetic particles, and additives including inorganic fine particles having 0.05–4 μm average particle diameter and 0.1–40 $m^2/g$ specific surface area, and negatively charged hydrophobic silica fine particles having 50–350 $m^2/g$ specific surface area that have been treated with silicone oil by a surface treatment. The additives are added to the surface of the magnetic toner base particles.

It is preferable that the magnetic toner is used for an electrophotographic method comprising the steps of:

forming electrostatic latent images on a movable photoconductor containing a stationary magnet, magnetically attracting the magnetic toner to the surface of the photoconductor positioned in a toner sump, the magnetic toner comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that are treated with silicone oil by a surface treatment, holding the magnetic toner on the surface of the photoconductor, shifting the photoconductor so as to face a toner collecting electrode roller which has a magnet inside and is positioned at a predetermined position from the surface of the photoconductor, and leaving the toner at an image section of the photoconductor and collecting the toner at a non-image section by the toner collecting electrode roller to thereby develop an image;

transferring the magnetic toner from the photoconductor to transfer paper by electrostatic force; and removing residual magnetic toner left on the photoconductor in the transferring step to clean the photoconductor.

It is also preferable that the magnetic toner is used for an electrophotographic method that comprises the steps of:

forming electrostatic latent images on a movable photoconductor containing a stationary magnet, magnetically attracting the magnetic toner to the surface of the photoconductor positioned in a toner sump, the magnetic toner comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that are treated with silicone oil by a surface treatment, holding the magnetic toner on the surface of the photoconductor, shifting the photoconductor so as to face a toner collecting electrode roller which has a magnet inside and is positioned at a predetermined position from the surface of the photoconductor, and leaving the toner at an image section of the photoconductor and collecting the toner at a non-image section by the toner collecting electrode roller;

passing transfer paper between the photoconductor and a conductive elastic roller which is in contact with the photoconductor, and transferring the magnetic toner from the photoconductor to the paper by transfer bias voltage applied to the conductive elastic roller to transfer the toner; and removing residual magnetic toner left on the photoconductor in the transferring step to clean the photoconductor.

It is further preferable that the magnetic toner is used for an electrophotographic method comprising the steps of:

forming electrostatic latent images on a movable photoconductor containing a stationary magnet, magnetically attracting the magnetic toner to the surface of the photoconductor positioned in a toner sump, the magnetic toner comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that are treated with silicone oil by a surface treatment, holding the magnetic toner on the surface of the photoconductor, shifting the photoconductor so as to face a toner collecting electrode roller which has a magnet inside and is positioned at a predetermined position from the surface of the photoconductor, and leaving the toner at an image section of the photoconductor and collecting the toner at a non-image section by the toner collecting electrode roller to develop an image;

passing transfer paper between the photoconductor and a conductive elastic roller which is in contact with the photoconductor, and transferring the magnetic toner from the photoconductor to the paper by transfer bias voltage applied to the conductive elastic roller to transfer an image;

removing residual magnetic toner left on the photoconductor in the transferring step to clean the photoconductor; and collecting the residual magnetic toner removed in the cleaning step for recycling toner for re-use in the developing step.

It is preferable that the amount of magnetic particles is 15–70% by weight of the magnetic toner base particles, that the inorganic fine particles are titanate fine particles or zirconate fine particles prepared by a hydrothermal method or an oxalate thermal decomposition method and are contained in the magnetic toner base particles at 0.1–5.0% by weight, that the amount of the negative charge hydrophobic silica fine particles is 0.1–5.0% by weight of the base particles, and that the inorganic fine particles have opposite sign chargeable properties with respect to the base particles and have from +3 μC/g to +30 μC/g charge amount with respect to the base particles.

The electrophotographic method applied in the invention includes the steps of sprinkling and adhering the toner by magnetic force to the photoconductor which has a fixed internal magnet and forms electrostatic latent images, transporting the toner to an electrode roller section, applying a.c. bias to the roller, and removing the toner at the non-image section of the photoconductor by electrostatic and magnetic force. In other words, the device used in this method is miniaturized and improved in its performance, compared with ones used in the cascade developing method, by depositing a magnet inside the photoconductor and applying alternating voltage to the electrode.

In the invention, development is almost completed when the toner is first sprinkled on the photoconductor. The electrode roller circulates the toner in a toner sump and collects the toner at the non-image section at the same time. In other words, the photoconductor holds and carries the toner from the toner sump to the developing field. The electrode roller and the photoconductor rotate in opposite directions at a section where the roller and the photoconductor face each other.

Since the developing step in the invention is simple, charging opportunities for the toner are scarce, and it is hard to provide toner with high chargeable properties. When the treatment of using the conductive elastic roller is added to the transferring step, the magnetic toner is required to be more fluid and have better chargeable properties than conventional toners in order to prevent hollow characters and scattering transfer.

Furthermore, the residual toner is recycled in the invention. Since the electrode roller and the photoconductor rotate in opposite directions at a section where the roller and the photoconductor face each other, the toner can be immediately removed from a collecting section even if toner with reduced fluidity aggregates and is transported to the collecting section.

Images of high quality cannot be stably obtained if the fluidity and chargeable properties of the toner in the developing step, the transferring step (using the conductive elastic roller), and the toner recycling step are higher than the conventional level. Formation of film on the photoconductor can be prevented to a greater extent than at the conventional level.

When the negative charge hydrophobic silica fine particles whose surfaces are treated with silicone oil are used as the additive, magnetic toner with high negative chargeable properties is provided, thus improving the quality of images. In other words, since silanol groups which are hydrophilic groups on the surfaces of the silica fine particles are coated completely, the silica fine particles obtain high negative chargeable properties due to the siloxane groups present on the surfaces.

However, since the silica particles themselves have high chargeable properties and are prone to secondary aggregation, fluidity declines and white point noise and filming generate due to the aggregation of silica particles.

Thus, the negatively charged hydrophobic silica having 50–350 $m^2/g$ specific surface area and that is treated with a silicone oil such as shown in the following Formula 1 is used and is mixed with the inorganic fine particles, so that aggregation of silica particles is significantly controlled. The reason for this is not entirely understood, but it is thought that shearing force is added to silica particles when they are mixed with the inorganic particles, thus eliminating aggregation. Due to the elimination, the fluidity of the toner increases and the chargeable properties of the toner improve. It is also found that the fluidity and chargeable properties of the toner are stable and images of high quality are provided, even if residual toner is recycled.

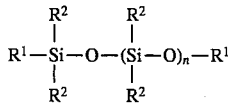

Formual 1 wherein $R^1$ and $R^2$ each represents hydrogen, an alkyl group, an aryl group or an alkoxy group, and n represents the degree of polymerization.

The polymerization degree (n) is preferably 10–100. When n is less than 10, it becomes more difficult to obtain high negative chargeable properties. On the other hand, if n is more than 100, the surface treatment tends to become uneven.

When the specific surface area is less than 50 $m^2/g$, the fluidity of toner decreases. If the specific surface area is more than 350 $m^2/g$, aggregation becomes intense and cannot be prevented even if silica is mixed with the inorganic fine particles.

The generation of film on the photoconductor is difficult to prevent only by eliminating the aggregation of silica and providing uniform dispersion. Suspended silica particles cannot be controlled completely, so they adhere to the photoconductor. The particles are driven to the photoconductor by stress, thus generating toner film. The stress is due to a cleaning blade and a transferring roller. More specifically, since the particles adhere to the photoconductor, an irradiated laser beam is blocked or scattered, so that printed images will have hollow characters and lines or become blurry. Especially in the electrophotographic method to which the magnetic toner of the invention is applied, film is easily generated since toner adheres to the entire surface of the photoconductor in the developing step. Also, if the residual toner is recycled, latitude with respect to the filming becomes narrower.

However, by using the inorganic fine particles as the additive, the photoconductor is not scratched, and foreign matter adhered to the photoconductor can be removed.

The inorganic fine particles separate from toner, adhere to the photoconductor by themselves, are supplied to a cleaning section without being transferred to a transfer material in the transferring step, and adhere to the cleaning blade. Since the inorganic fine particles adhere to the cleaning blade, the foreign matter adhered to the photoconductor can be removed.

When inorganic fine particles having 0.05–4 μm average particle diameter and 0.1–40 $m^2/g$ specific surface area are used, the dispersion of the particles improves. The particles are also adhered evenly to the magnetic toner base particles and are effective against filming. If the average particle diameter is less than 0.05 μm, the dispersion of the particles tends to decline, and the aggregated objects tend to increase, so that images become poor. Also, when the specific surface area is more than 40 $m^2/g$, the dispersion of the inorganic fine particles tends to decrease, thus increasing aggregated objects and providing poorer images. If the average particle diameter of the particles is more than 4 μm, the particles tend to separate from the toner base particles, thus harming the photoconductor. There are too many large particles when the specific surface area is less than 0.1 $m^2/g$, so that the inorganic fine particles separate from the toner base particles, and the photoconductor is then harmed.

In the electrophotographic method to which the magnetic toner of the invention is applied, toner is adhered to the entire surface of the photoconductor in the developing step, so that only inorganic fine particles are consumed when the particles separate from the toner and adhere to the photoconductor. If copies with a low black-area ratio are continuously taken, only inorganic fine particles are consumed, thus gradually reducing the effect against filming. In addition, there will be an excessive amount of inorganic fine particles in the residual toner, thus providing a negative effect on the chargeable properties and fluidity of recycled toner.

However, by adding inorganic fine particles of the invention, the particles are kept on the toner base particles at a desirable level, so that the consumption of inorganic fine particles can be controlled even if copies with a low black-area ratio are continuously taken. As a result, as long as there is magnetic toner, the inorganic fine particles are present. Even if the residual toner is recycled, the effect in resisting against filming is maintained.

Magnetic powder (magnetic particles) is contained in the magnetic toner of the invention. The magnetic powder includes, for example, metallic powder such as iron, manganese, nickel and cobalt powder and ferrite such as iron, manganese, nickel, cobalt and zinc. The average particle diameter of the powder is 0.05–1 μm, more preferably 0.1–0.6 μm. When the particle diameter is smaller than 0.05 μm, the particles aggregate and cannot be dispersed. The particles are exposed and harm the photoconductor when their diameter is larger than 1 μm. The added amount of the powder is preferably 15–70% by weight. If the amount is less than 15%, the toner tends to scatter increasingly. When the amount is more than 70%, the charging volume of toner tends to decline, thus deteriorating the quality of images.

Inorganic fine particles are also contained in the magnetic toner of the invention. The particles include $CaSiO_3$, $LaCrO_3$, $AlPO_4$, $NbP_3O_4$, $LaFeO_3$, $LiNbO_3$, $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $MnSiO_3$, $MgSiO_3$, $CaSiO_3$, $MoO_2$, $SnO_2$, $ZnO_2$, $MgO_2$, NiO, $V_2O_5$, $Nb_2O_5$, $WO_2$, $Nb_2O_3$—$TiO_2$, $Ta_2O_5$—$TiO_2$, $V_2O_5$—$ZnO_2$ and the like. It is preferable that zirconate fine particles or titanate fine particles prepared by a hydrothermal method or an oxalate thermal decomposition method are used as the inorganic fine particles. For example, the titanate fine particles include $SrTiO_3$, $BaTiO_3$, $MgTiO_3$, $AlTiO_3$, $CaTiO_3$, $PbTiO_3$, $FeTiO_3$ , and the zirconate fine particles include $SrZrO_3$, $BaZrO_3$, $MgZrO_3$, $AlZrO_3$, $CaZrO_3$, $PbZrO_3$.

The method of preparing fine particles in a hydrothermal condition includes a hydrothermal oxidation method, a hydrothermal precipitation method, a hydrothermal composition method, a hydrothermal dispersion method, a hydrothermal crystalization method, a hydrothermal hydrolysis method, a hydrothermal agitate-mixing method, a hydrothermal mechano-chemical method and the like. Among these methods, the hydrothermal oxidation method, the hydrothermal precipitation method, the hydrothermal composition method, the hydrothermal dispersion method and the hydrothermal hydrolysis are preferred.

In the oxalate thermal decomposition method, a mixed solution A (at lower than 30° C.) of $TiCl_4$ (aq) and $BaCl_2 \cdot 2H_2O$ is prepared when the particles are, for example, $BaTiO_3$ fine particles. Mixed solution A is added to an oxalic acid $(COOH)_2 \cdot 2H_2O$ solution which is kept at 80° C., thus providing $BaTiO(C_2O_4) \cdot 4H_2O$. $BaTiO_3$ fine particles are obtained after heating $BaTiO(C_2O_4) \cdot 4H_2O$ to higher than 600° C.

The fine particles prepared in the above-noted method rarely aggregate and have a narrow particle size distribution, good fluidity and spherical shapes. Thus, when the particles are added and mixed in the toner, they disperse well and adhere to the toner base particles uniformly. Also, since the shapes of the particles are spherical, the particles do not harm the photoconductor.

The amount of inorganic fine particles relative to the amount of the magnetic toner base particles (100 weight parts) is 0.1–5.0 weight parts. If the amount is less than 0.1 weight parts, the particles have little effect in resisting against filming. When the amount is more than 5.0 weight parts, the particles are likely to aggregate, thus harming the photoconductor.

The negative charge hydrophobic silica fine particles treated with silicone oil by a surface treatment are contained in the magnetic toner of the invention. Silica fine particles prepared by the oxidation of a steam phase of silicate halide compound are preferable as the silica fine particles. For instance, the thermal decomposition oxidation reaction in the oxyhydrogen flame of silicon tetrachloride gas is utilized. The following Formula 2 shows the reaction.

Formula 2

$$SiCl_4+2H_2+O_2 \rightarrow SiO_2+4HCl$$

The silicone oil used for the surface treatment is preferably polydimethyl silicone oil. Silicone oil including alkyl groups, silicone oil including fluorine groups, or the like can also be used.

A conventional method is applied as a surface treatment method, and conventional methods include a mixing method using a mixer such as a Henschel mixer and a method of injecting silicone oil.

The amount of silica relative to the amount of the magnetic toner base particles (100 weight parts) is preferably 0.1–5.0 weight parts. In order to prevent the aggregation of toner itself, the silica should preferably be added at 0.1 weight parts or above. When the amount is more than 5.0 weight parts, suspending silica increases.

It is also preferable that the inorganic fine particles have wrong sign chargeable properties with respect to the toner base particles and have from +3 μC/g to +30 μC/g tribo-charge amount in a blow-off measurement method. Thus, the dispersion of inorganic fine particles improves, and the particles adhere to the toner base particles evenly and are used effectively against filming.

Since the inorganic fine particles have opposite chargeable properties, they rarely adhere to the transferring roller. The particles are also excellent for preventing filming because they are supplied to the cleaning blade section.

When the tribo-charge amount of the particles is less than +3 μC/g, the particles separate more from the toner base particles and are selectively consumed more. Also, as the amount of particles adhered to the transferring roller increases, the effect against filming declines. When the tribo-charge amount is more than +30 μC/g, the chargeable properties of the toner are negatively influenced and fog then generates.

It is particularly preferable to use an insulating one-component toner as the magnetic toner of the invention. When the one-component toner is used, a mixing and agitating function and the control of toner density needed for a two-component development are unnecessary, so that the device becomes simple.

The magnetic toner of the invention can be manufactured by a conventional method, and can be manufactured, for example, by a mixing process, a kneading process, a pulverizing process and an addition process and, if necessary, a classification process.

As the mixing process, a conventional method can be applied in which binder resin, magnetic particles and internal additives such as an tribo-charge amount controlling agent, a detachant and pigment are evenly dispersed by a mixer or the like having an agitating blade.

In the kneading process, the mixed material is heated, and the internal additives are dispersed in the binder resin by shearing force. Any conventional heating and heading device can be used for the process. The heating and kneading device which heats and kneads by adding shearing force includes, for example, a three-roll type, a one-shaft screw type, a two-shaft screw type and an intensive mixer type. A chunk obtained from the process is pulverized by a cutter mill or the like, and is then processed to fine particles by a jet mill or the like. If necessary, the fine particles are further cut by a dispersion separator. As a result, a predetermined particle size distribution is obtained. The particles can also be pulverized and separated by a mechanical type pulverizer or classifier. For example, there is a method of pulverizing particles by introducing toner to a minute gap between a fixed stator and a roller. Conventional methods can be used for applied to the process.

Additives are added to the magnetic toner base particles which are prepared in the above-noted processs. Any conventional method of addition can be applied to the process.

The binder resin used for the magnetic toner of the invention is a vinyl-based polymer which is polymerized or copolymerized vinyl-based monomer. Monomer styrene constituting the binder resin, for example, includes styrene such as styrene, α-methylstyrene and P-chlorostyrene, and its substitution product; alkylester acrylic constituting the binder resin includes acrylic acid, methyl acrylic, ethyl acrylic, butyl acrylic, dodecyl acrylic, octyl acrylic, isobutyl acrylic and hexyl acrylic; alkyl ester methacrylate includes monocarboxylic acid having a double bond such as methyl methacrylate, ethyl methacrylate, butyl methacrylate, octyl methacrylate, isobutyl methacrylate, dodecyl methacrylate and hexyl methacrylate, and its substitution product.

Conventional methods are applied as methods of manufacturing these copolymers. Such methods include, for example, bulk polymerization, solution polymerization, suspension polymerization and emulsion polymerization.

Copolymers used for the magnetic toner of the invention are a styrene type, and the styrene type copolymer is preferably included in the toner at 50–95% by weight. When the amount of styrene in the toner is less than 50% by weight, the melt characteristics of the toner decrease. Also, the fixing properties of the toner become incomplete, and the crushability of the toner deteriorates.

Other conventional polymers or copolymers such as polyester resin, epoxy resin and polyurethane resin can also be used as the binder resin. The polyester resin is generally prepared by the polycondensation reaction of acid and alcohol. Polyester resins used for the magnetic toner of the invention, include, for example, fumaric acid as acid and bisphenol A as alcohol.

If required, pigment or dye is added to the magnetic toner of the invention for the purpose of coloring, and controlling tribo-charge amount. The pigment or dye includes carbon black, black iron oxide, graphite, nigrosine, metallic complex of azo dye, copper phthalocyanine blue, Dupont oil red, aniline blue, benzine yellow, rose bengal or the mixture of these.

Furthermore, a detachant is also added to the magnetic toner of the invention, if necessary. The detachant can be, for example, a polyolefin such as polypropylene and polyethylene.

In the developing method which can further reduce the size, complexity and cost of a developing device, images with high picture density and low fog are obtained by using magnetic toner which can maintain high fluidity and chargeable properties. In the transferring step using the conductive elastic roller, toner itself rarely aggregates even if the concentration of toner such as for letters and lines is transferred with a predetermined stress, thus providing clear complete images.

Even if residual toner is recycled, the fluidity and the charge amount of the toner do not decrease. Also, the generation of film on the photoconductor is prevented.

Thus, a magnetic toner is provided which does not require the disposal of residual toner and prevents environmental contamination through recycling.

DETAILED DESCRIPTION OF THE INVENTION

Figure 1:
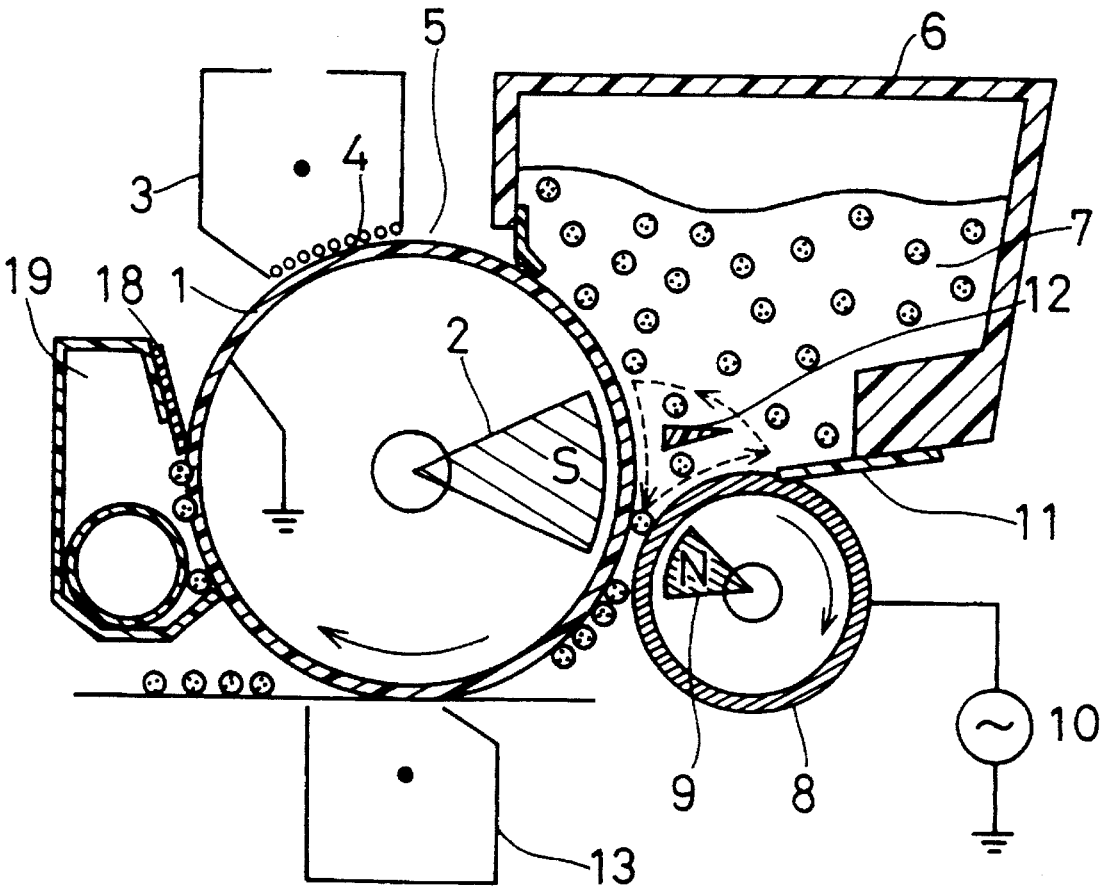
FIG. 1 is a cross-sectional view of a main section of an electrophotographic device in which magnetic toner of an embodiment of the invention is used.

The invention will be described by referring to the following examples and figures. The invention is not limited to these examples.

EXAMPLE 1

The composition of the toner base particles of a magnetic toner of an embodiment of the invention is shown in Table 1.

TABLE 1

| | | |
|---|---|---|
| Binder resin | styrene butyl acrylic copolymer resin (monomer ratio 82/18) melt viscosity at 135° C.: $1 \times 10^5$ (poise) melt viscosity at 145° C.: $2 \times 10^4$ (poise) | 62.5 wt. % |
| Magnetic particles | magnetite (BL220 manufactured by Titan Kogyo Kabushiki Gaisha) | 35 wt. % |
| * | Cr-metal complex azoic dye (S-34 manufactured by Orient Chemical Industries Co.) | 1 wt. % |
| ** | polypropylene (TP-32 manufactured by Sanyo Chemical Industries, Ltd.) | 1.5 wt. % |

*Charge controlling agent
**Parting agent

The magnetic toner of the embodiment was manufactured as described below. Materials indicated in Table 1 were mixed by a Henschel mixer (FM-20B manufactured by Mitsui Miike Engineering Co.), then heated and kneaded by a two-shaft type extruder (PCM-30 (manufactured by Ikekai Co.), pulverized roughly to less than 2 mm by Rotoplex (manufactured by Alpine AKG.), and pulverized to fine particles by an IDS-2 type jet mill (manufactured by Nippon Neumatic MFG. Co.). The particles were then cut by a DS2-type dispersion separator (manufactured by Nippon Neumatic MFG. Co.). As a result, particles of 8 μm average particle diameter were provided, and are called toner base particles. The magnetic toner of this embodiment is manufactured by mixing in additives with the base particles.

Table 2 shows additives used in the invention and comparative examples and their characteristics. TA-1 is barium titanate fine particles prepared by a hydrothermal composition method, TA-2 is barium zirconate fine particles manufactured by an oxalate hydrothermal composition method, TB-1 is lead titanate and TB-2 is alumina fine particles.

TABLE 2

| | (1) | (2) | (3) | (4) | (5) |
|---|---|---|---|---|---|
| TA-1 | 0.7 μm | 2.6 $m^2/g$ | +9.5 μC/g | $BaTiO_3$ | * |
| TA-2 | 0.35 μm | 5.1 $m^2/g$ | +4.5 μC/g | $BaZrO_3$ | ** |
| TB-1 | 0.7 μm | 3.0 $m^2/g$ | +2.0 μC/g | $PbTiO_3$ | |
| TB-2 | 1.0 μm | 2.0 $m^2/g$ | +1.5 μC/g | $Al_2O_3$ | |

(1) Average particle diameter
(2) specific surface area
(3) Charge amount
(4) Chemical composition
(5) Method
*oxalate thermal decomposition method
**hydrothermal composition method The barium titanate fine particles were prepared by mixing hydrous titanate and barium hydroxide and reacting them at 200° C. in a hydrothermal condition. Then, they were washed, filtered, dried and pulverized. The mol ratio of Ba/Ti is 0.998.

The blow-off method was applied to measure the chargeable properties of the agents. In the method, 0.2 g of a sample was blown for 180 seconds with 0.2 $kgf/cm^2$ air stress, and was then measured. As measurement conditions, roughly crushed magnetic toner base particles were put through a mesh having pores of 100 μm diameter, and the additives were mixed with the base particles at 10% mixing density. Then, the agents mixed with the base particles were put into a 100 ml polyethylene bottle, and were agitated for ten minutes at 60 rpm.

The specific surface area is measured by a regular BET measurement method of nitrogen absorption, and a specific surface area measuring apparatus (Flow Sorb2 2300) manufactured by Shimadzu Corporation was used.

The composition of the magnetic toner of this embodiment is shown in Table 3. The diameter of additive is measured by a regular laser diffraction particle sizer, and a measuring apparatus (Coulter LS) manufactured by Coulter electronics, inc. was used. And the toner diameter is measured by an electric resistance method, and a measuring apparatus (Coulter Multisizer) manufactured by Coulter electronics, inc. was also used.

TABLE 3

| Toner | Toner base | Inorganic fine particles | Hydrophobic silica (%) | |
|---|---|---|---|---|
| Toner A1 | (Table 1) 100 wt. parts | TA-1 1.0 part | R202 (**) (***) | 1.0 part |

TABLE 3-continued

| Toner | Toner base | Inorganic fine particles | Hydrophobic silica (%) |
|---|---|---|---|
| Toner A2 | (Table 1) 100 wt. parts | TA-2 1.0 part | TS-720 (****) (***) 1.0 part |
| Toner B1 | (Table 1) 100 wt. parts | TB-1 1.0 part | R974 (**) (*****) 1.0 part |
| Toner B2 | (Table 1) 100 wt. parts | TB-2 1.0 part | RX-200 (**) (******) 1.0 part |

*Surface treatment agent
**Nippon Aerosil Co., Ltd.
***polydimethyl silicone oil
****CABOT CO.
*****dimethyl dichlorosilane
******hexamethylene disilazane The fluidity and the charge amount of each magnetic toner are shown in the following Table 4.

TABLE 4

| Toner | Apparent density | Charge amount |
|---|---|---|
| Toner A1 | 0.61 g/cc | −30.0 μC/g |
| Toner A2 | 0.50 g/cc | −32.0 μC/g |
| Toner B1 | 0.49 g/cc | −23.5 μC/g |
| Toner B2 | 0.48 g/cc | −22.2 μC/g |

The fluidity is indicated as the apparent density. A powder tester (PT-E type) manufactured by Hosokawa Micron Co., Ltd. was used for the measurement. The charge amount was measured by the blow-off method, and 0.2 g of a sample was blown for 180 seconds with 0.2 kgf/cm$^2$ air stress and was measured. The measurement of charge amount was the same as the measurement applied to the additives, except that a non-coat ferrite carrier was used instead of the magnetic toner base particles.

It was confirmed that toners A1 and A2 have high charge amount and fluidity.

EXAMPLE 2

The electrophotographic method shown in FIG. 1 is explained below. A one-component developing method is applied in the example. In the figure, 1 is a photoconductor (organic photoconductive drum) which disperses phthalocyanine in a polyester type binder resin; 2 is a magnet which is fixed along the same shaft of photoconductor 1; 3 is a corona charging device which charges the photoconductor negative; 4 is a grid electrode which controls the charge potential of the photoconductor; 5 is signaling light (laser beam); 7 is a magnetic one-component toner; 6 is a toner sump for supplying magnetic toner 7 to the surface of photoconductor 1; 8 is a non-magnetic electrode roller deposited with a gap between itself and photoconductor 1; 9 is a magnet which is deposited inside electrode roller 8 and does not rotate; 10 is an alternating high voltage power source applied to electrode roller 8; and 11 is a scraper made of polyester film for scraping toner on the electrode roller. Residual toner at a non-image section is collected by electrode roller 8.

A damper 12 makes the flow of toner in the toner sump smooth and prevents toner from being pulverized by its own weight and being stuck between the photoconductor and the electrode roller.

A corona transfer charging device 13 transfers toner images on the photoconductor to paper.

Magnetic flux density on the surface of photoconductor 1 is 600 Gs. Magnetic force inside the electrode roller is increased so as to improve conveying properties. The magnetic pole angle (θ) of magnet 2 shown in the figure is 15°. The diameter of photoconductor 1 is 30 mm, and it rotates at 60 mm/s peripheral speed in an arrow direction shown in the figure. The diameter of electrode roller 8 is 16 mm, and it rotates at 40 mm/s peripheral speed in the opposite direction to the rotating direction of the photoconductor (indicated as an arrow in the figure) at a section where the roller and the drum face each other. The gap between photoconductor 1 and electrode roller 8 is 300 μm.

Photosensitive drum 1 was charged to −500 V by corona charging device 3 (applied voltage −4.5 kV, and −500 V at grid 4). Laser beam 5 was irradiated on photoconductor 1, thus forming electrostatic latent images. The exposure potential of the photoconductor was −90 V. In toner sump 6, magnetic toner 7 was adhered to the surface of photoconductor 1 by the magnet. Then, photoconductor 1 was passed in front of electrode roller 8. When photoconductor 1 was passed through an uncharged region, 750 VO-p (1.5 kV peak to peak) alternating voltage (1 kHz in frequency) was applied to electrode roller 8 from alternating current high voltage power source 10. Then, the same alternating voltage (which was superimposed −350 V dc voltage) was applied to electrode roller 8 from alternating current high voltage power source 10, when photoconductor 1 charged to −500 V and formed with the electrostatic latent images was passed. As a result, toner that adhered to the charged sections of photoconductor 1 was collected by electrode roller 8, and negatively and positively inverted toner images in an image section only were left on photoconductor 1. Toner that adhered to electrode roller 8 was collected by scraper 11, and was returned to toner sump 6 for the next image formation. After the toner images on photoconductor 1 had been transferred to transfer paper by transfer charging device 13, they were fixed by heat with a fixing device (not shown in the figure), thus providing copied images.

Copying tests were directed by applying the electrophotographic method shown in FIG. 1 and using magnetic toner A1 shown in Example 1. Image density was measured by a reflection density measuring device (manufactured by Macbeth Co.), and the results were evaluated. According to the results, it was found that images were solid black and even with complete letters and without disordering horizontal lines and scattered toner. The images were high in quality, reproducing 16/mm image lines of 1.4 density. At the same time, images with 1.4 or higher image density were obtained, and there was also no fog in the non-image section.

A long-term copying test of 10,000 sheets was carried out. There was no decline in the fluidity of the toner after copying 10,000 sheets, and the toner kept a high tribo-charge amount. There was also no generation of filming on the photoconductor. The density of images was kept constant throughout the long-term copying. Table 5 shows the fluidity and the image density of toner at the beginning of and after the 10,000 sheet copying test.

TABLE 5

| Toner | Apparent density * | Apparent density ** | Image density * | Image density ** |
|---|---|---|---|---|
| Toner A1 | 0.61 | 0.60 | 1.42 | 1.41 |
| Toner A2 | 0.50 | 0.48 | 1.40 | 1.38 |
| Toner B1 | 0.49 | 0.40 | 1.10 | 0.90 |
| Toner B2 | 0.48 | 0.39 | 1.15 | 0.98 |

*beginning of the test
**after the test

EXAMPLE 3

Figure 2:
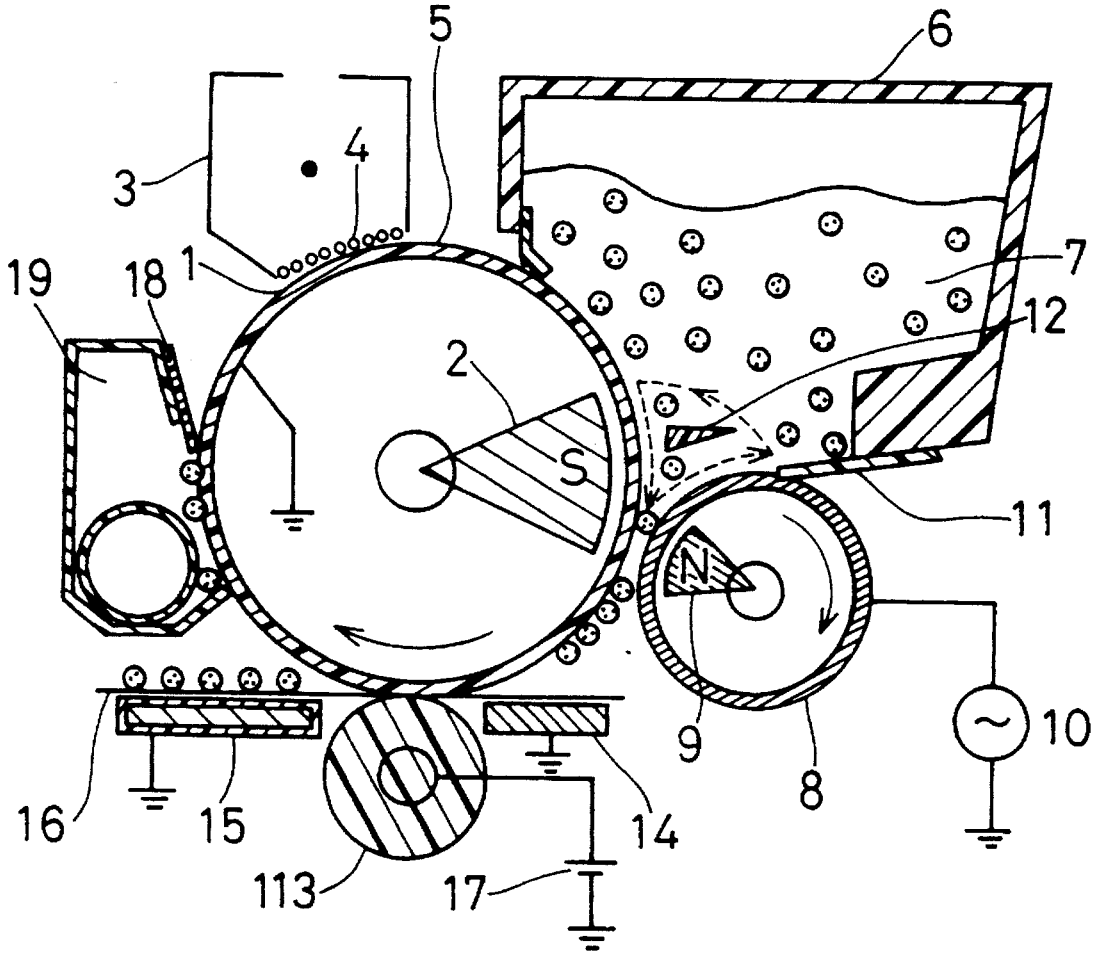
FIG. 2 is a cross-sectional view of a main section of an electrophotographic device in which magnetic toner of an embodiment of the invention is used.

An electrophotographic method of one embodiment is shown in FIG. 2. The corona transfer used in the method shown in FIG. 1 is replaced with roller transfer for the transferring step in the method shown in FIG. 2.

In the figure, 113 is a transfer roller for transferring toner images on the photoconductor to paper, and is in contact with photoconductor 1. The transfer roller is an elastic roller which is composed of a metallic shaft and a conductive elastic member around the shaft. The stress of a single transfer roller 113 (about 216 mm) against photoconductor 1 is 0–2,000 g, preferably 500–1,000 g. The stress was calculated from the product of displacement and spring factor of a spring used for pressing transfer roller 113 against photoconductor 1. The contacting width between the photoconductor and the roller is about 0.5–5 mm. The rubber hardness of transfer roller 113 is measured by the Asker C measurement method (using not a roller but a block) and is generally less than 80 degrees, more preferably 30–40 degrees. Conductive urethane elastomer having $10^7\Omega$ value of resistance (500 V was applied to electrodes provided to the shaft and the surface) including foaming lithium salt was applied around the shaft of 6 mm diameter. The outside diameter of transfer roller 113 was 16.4 mm, and the hardness was 40 degrees, measured by Askar C. Transfer roller 113 was in contact with photoconductor 1 by providing stress to the shaft of the roller with a metallic spring. The stress was about 1,000 g.

A chute 14 made of a conductive material introduces transfer paper to transfer roller 113; 15 is a carrier guide which is a conductive member coated with an insulator. Chute 14 and carrier guide 15 are grounded directly or through resistance. In the figure, 16 is transfer paper; 17 is a voltage-generating power source for applying voltage to transfer roller 113; 18 is a cleaning blade for removing residual toner left from the transferring step, and 19 is a cleaning box for holding the residual toner.

Even though an elastic urethane blade was used as the cleaning blade, the same results can be provided from a fur brush applied with bias or a conductive metallic roller. The rest of the characteristics of the example are the same as the ones in FIG. 1.

By using the electrophotographic device shown in FIG. 2, copying tests were directed with magnetic toner A1 of the invention. Image density was measured by a reflection densitometer manufactured by Macbeth Co., and the results were evaluated. According to the results, it was found that images were even and had solid black with complete letters, and there were no disordering horizontal lines and scattered toner. The images were high in quality, reproducing 16/mm image lines of 1.4 density. At the same time, images with 1.4 or higher image density were obtained, and there was also no fog in the non-image section.

The long-term copying test of 10,000 sheets was carried out. There was no decline in the fluidity of the toner after copying 10,000 sheets, and the toner kept a high quantity of tribo-charge amount. There was also no generation of filming on the photoconductor. The density of images was kept constant throughout the copying.

EXAMPLE 4

Figure 3:
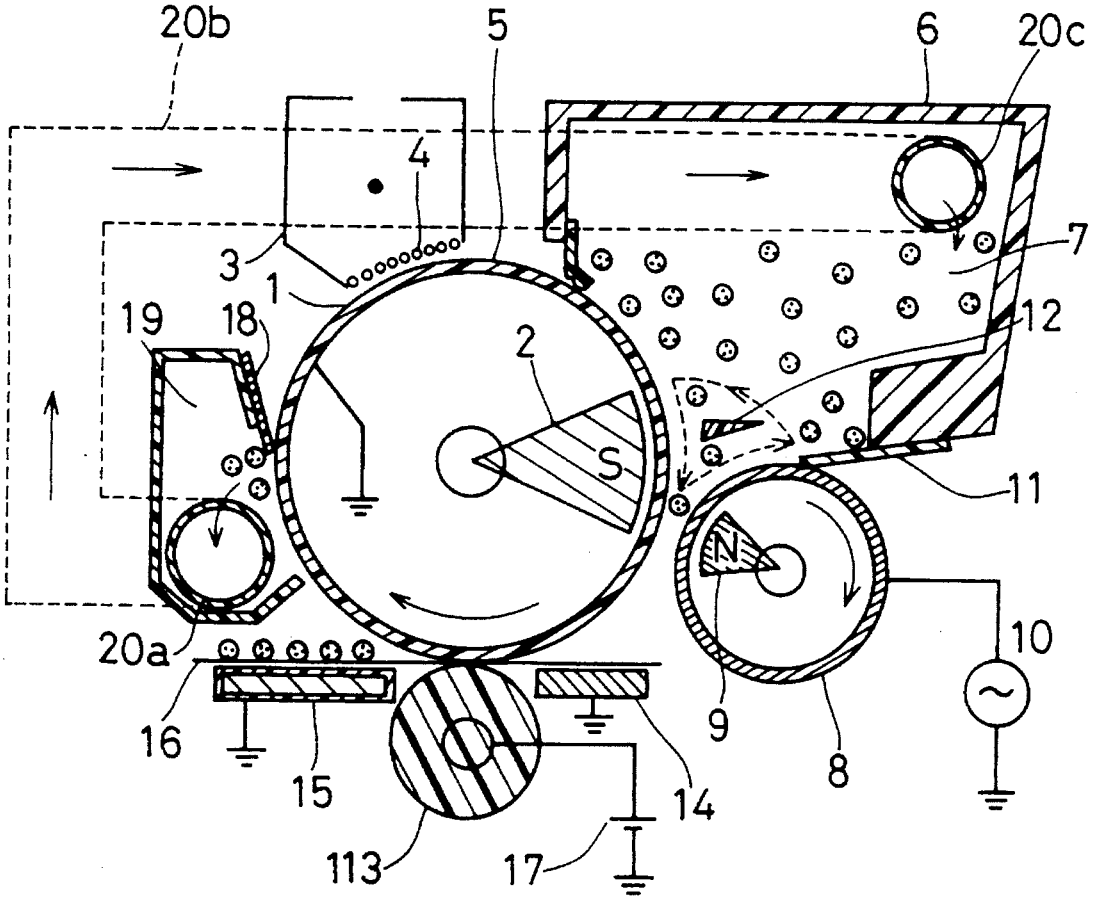
FIG. 3 is a cross-sectional view of a main section of an electrophotographic device in which magnetic toner of an embodiment of the invention is used.

An electrophotographic method of an embodiment is shown in FIG. 3. In FIG. 3, residual toner recycling is added to the electrophotographic method shown in FIG. 2. Residual toner collected in cleaning box 19 is sucked through a transportation pipe inlet 20*a*, passes through a transportation pipe 20*b*, and is transported to toner sump 6, so that residual toner left from the transferring step is recycled. The method of transporting the residual toner includes a method of using air, a method of transporting the toner in a spiral condition, a method of using magnetic force, a vibrating method, and other known methods. However, the method is not limited. Other characteristics of this example were the same as the characteristics shown in FIG. 2.

Copying tests were conducted by applying the electrophotographic device shown in FIG. 3 and using magnetic toner A1 of the invention. Image density was measured by a reflection density measuring device (manufactured by Macbeth Co.), and the results were evaluated. According to the results, it was found that images were even and solid black with complete letters and without disordering horizontal lines and scattered toner. The images were high in quality, reproducing 16/mm image lines of 1.4 density. At the same time, images with 1.4 or higher image density were obtained, and there was also no fog in the non-image section.

While the residual toner was recycled, the long-term copying test of 10,000 sheets was carried out. There was no decline in the fluidity of the toner after copying 10,000 sheets, and the toner kept a high quantity of tribo-charge amount. There was also no generation of filming on the photoconductor. The density of images was kept constant throughout the copying, and the copied images had low fog. The toner was preferably recycled.

Comparative Example 1

The same composition and process as in Example 1 were conducted so as to prepare magnetic toner B1, except that different additives from the ones in Example 1 were used.

As the additives, lead titanate fine particles and hydrophobic silica treated with dimethyl dichlorosilane were used.

Copying tests were directed with magnetic toner B1 by applying the electrophotographic method shown in Example 1.

Image density was measured by a reflection densitometer (manufactured by Macbeth Co.). As a result, it was found that images had low image density and a lot of fog.

In the long-term copying test, toner film was found after 2,000 copies were made.

Comparative Example 2

The same composition and process as in Example 2 were directed so as to prepare magnetic toner B1, except that different additives from the ones in Example 1 were used.

As the addition agents, hydrophobic silica treated with hexamethylene disilazane and alumina fine powder were used.

Image density was measured by a reflection densitometer (manufactured by Macbeth Co.). As a result, it was found that images had low image density and a lot of fog.

In the long-term copying test, toner film was found after 1,000 copies were made.

Comparative Example 3

The same toner as the one shown in Example 2 was prepared, except that the amount of added magnetic powder was 10% by weight in this example. The toner was heavily scattered and was not good for practical use.

Comparative Example 4

The same toner as the one shown in Example 2 was prepared, except that the amount of added magnetic powder was 80% by weight in this example. The toner had a low charge amount, and images had a lot of fog, so that the toner was not good for practical use.

Comparative Example 5

The same toner as the one shown in Example 2 was prepared, except that the amount of added silica was 0.05% by weight in this example. The toner had poor fluidity, and was not good for practical purpose.

Comparative Example 6

The same toner as the one shown in Example 2 was prepared, except that the amount of added silica was 6 weight parts in this example. The silica aggregated intensively, and a lot of white points adhered to a solid black image section, so that the toner was not good for practical use.

Comparative Example 7

The same toner as the one shown in Example 2 was prepared, except that the amount of added barium titanate fine particles was 0.05 weight parts in this example.

In the long-term copying test, toner filming was found after 1,000 copies were made. Practical images were not obtained.

Comparative Example 8

The same toner as the one shown in Example 2 was prepared, except that the amount of added barium titanate fine particles was 6 weight parts in this example. The barium titanate fine particles aggregated intensively, and the photoconductor was harmed. In other words, the toner was not good for practical use.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. Magnetic toner comprising magnetic toner base particles comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that were treated with silicone oil by a surface treatment, wherein the inorganic fine particles are prepared by a hydrothermal method or an oxalate thermal decomposition method and comprise at least one compound selected from the group consisting of $CaSiO_3$, $LaCrO_3$, $AlPO_4$, $NbP_3O_4$, $LaFeO_3$, $LiNbO_3$, $SrTiO_3$, $BaTiO_3$, $CaTiO_3$, $PbTiO_3$, $FeTiO_3$, $SrZrO_3$, $BaZrO_3$, $CaZrO_3$, $PbZrO_3$, $MnSiO_3$, $MgSiO_3$, $MoO_2$, $SnO_2$, $ZnO_2$, $MgO_2$, NiO, $V_2O_5$, $Nb_2O_5$, $Wo_2$, $Nb_2O_3$—$TiO_2$, $Ta_2O_5TiO_2$ and $V_2O_5$—$ZuO_2$.

2. The magnetic toner as in claim 1, wherein the magnetic particles are present in an amount of from 15–70% by weight of said magnetic toner base particles.

3. The magnetic toner as in claim 1, wherein the magnetic particles are at least one metallic powder selected from the group consisting of iron, manganese, nickel and cobalt.

4. The magnetic toner as in claim 1, wherein the magnetic particles are at least one ferrite selected from the group consisting of iron, manganese, nickel, cobalt and zinc.

5. The magnetic toner as in claim 1, wherein the magnetic particles have less than 1 μm average particle diameter.

6. The magnetic toner as in claim 1, wherein the magnetic particles have less than 0.6 μm average particle diameter.

7. The magnetic toner as in claim 1, wherein the inorganic fine particles are prepared by a hydrothermal method selected from the group consisting of a hydrothermal oxidation method, a hydrothermal precipitation method, a hydrothermal composition method, a hydrothermal dispersion method, a hydrothermal crystallization method, a hydrothermal hydrolysis method, a hydrothermal agitate mixing method and a hydrothermal mechano-chemical method.

8. The magnetic toner as in claim 1, wherein the inorganic fine particles are titanate fine particles prepared by a hydrothermal method or zirconate fine particles prepared by a hydrothermal method.

9. The magnetic toner as in claim 1, wherein the inorganic fine particles are titanate fine particles prepared by an oxalate thermal decomposition method or zirconate fine particles prepared by an oxalate thermal decomposition method.

10. The magnetic toner as in claim 1, wherein the inorganic fine particles are present in an amount of from 0.1–5.0 weight parts relative to 100 weight parts of the magnetic toner base particles.

11. The magnetic toner as in claim 1, wherein the negatively charged hydrophobic silica fine particles are present in an amount of from 0.1–5.0 weight parts relative to 100 weight parts of the magnetic toner base particles.

12. The magnetic toner as in claim 1, wherein the inorganic fine particles have oppositely chargeable properties with respect to the magnetic toner base particles, and have from +3μ C/g to +30μ C/g charge amount with respect to said magnetic toner base particles.

13. The magnetic toner as in claim 1, wherein the silicone oil used to treat the surface of silica fine particles is at least one oil selected from the group consisting of polydimethyl silicone oil, silicone oil containing alkyl groups, and silicone oil containing fluorine.

14. The magnetic toner as in claim 1, wherein the binder resin is a vinyl-based polymer or a copolymer vinyl-based polymer.

15. The magnetic toner as in claim 1, wherein the binder resin comprises a monomer; and wherein said monomer is at least one silicone oil selected from the group consisting of styrene, σ-methylstyrene, p-chlorostyrene, substitution product of styrene, σ-methylstyrene or p-chlorostyrene, acrylic acid, methacrylic acid, alkyl acrylic ester, alkyl methacrylate ester, and substitution product of acrylic acid, methacrylic acid, alkyl acrylic ester or alkyl methacrylate ester.

16. An electrophotographic method which comprises:

forming electrostatic latent images on a movable photoconductor containing a stationary magnet, magnetically attracting a magnetic toner to the surface of said photoconductor positioned in a toner sump, said magnetic toner comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that were treated with silicone oil by a surface treatment, holding said magnetic toner on the surface of said photoconductor, shifting said photoconductor so as to face a toner collecting electrode roller which has an internal magnet and is positioned at a predetermined position from the surface of said photoconductor, and leaving said magnetic toner at an image section of said photoconductor and collecting said magnetic toner at a non-image section of said photoconductor by said toner collecting electrode roller to develop an image;

transferring said magnetic toner from said photoconductor to transfer paper by electrostatic force; and subsequently removing residual magnetic toner left on said photoconductor from said transferring step to clean the photoconductor.

17. The electrophotographic method as in claim 16, wherein the cleaning is carried out with an elastic urethane blade.

18. The electrophotographic method as in claim 16, wherein the cleaning is carried out with a bias-applied fur brush.

19. The electrophotographic method as in claim 16, wherein the cleaning is carried out with a bias-applied conductive metallic roller.

20. An electrophotographic method which comprises:

forming electrostatic latent images on a movable photoconductor containing a stationary magnet, magnetically attracting a magnetic toner to the surface of said photoconductor positioned in a toner sump, said magnetic toner comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that were treated with silicone oil by a surface treatment, holding said magnetic toner on the surface of said photoconductor, shifting said photoconductor so as to face a toner collecting electrode roller which has an internal magnet and is positioned at a predetermined position from the surface of said photoconductor, and leaving said magnetic toner at an image section of said photoconductor and collecting said magnetic toner at a non-image section of said photoconductor by said toner collecting electrode roller to develop an image;

passing transfer paper between said photoconductor and a conductive elastic roller which is in contact with said photoconductor, and transferring said magnetic toner from said photoconductor to said transfer paper by transfer bias voltage applied to said conductive elastic roller; and subsequently removing residual magnetic toner left on said photoconductor in said transferring step to clean the photoconductor.

21. The electrophotographic method as in claim 20, wherein the cleaning is carried out with an elastic urethane blade.

22. The electrophotographic method as in claim 20, wherein the cleaning is carried out with a bias-applied fur brush.

23. The electrophotographic method as in claim 20, wherein the cleaning is carried out with a bias-applied conductive metallic roller.

24. The electrophotographic method as in claim 20, wherein the conductive elastic roller used in the transferring step comprises a urethane foaming material, to which a conductive additive is added, as an elastic member.

25. The electrophotographic method as in claim 24, wherein the conductive additive is lithium salt.

26. The electrophotographic method which comprises:

forming electrostatic latent images on a movable photoconductor containing a stationary magnet, magnetically attracting a magnetic toner to the surface of said photoconductor positioned in a toner sump, said magnetic toner comprising at least binder resin and magnetic particles, and an additive comprising inorganic fine particles of 0.05–4 μm average particle diameter and 0.1–40 $m^2/g$ specific surface area, and negatively charged hydrophobic silica fine particles having 50–350 $m^2/g$ specific surface area and that were treated with silicone oil by a surface treatment, holding said magnetic toner on the surface of said photoconductor, shifting said photoconductor so as to face a toner collecting electrode roller which has an internal magnet and is positioned at a predetermined position from the surface of said photoconductor, and leaving said magnetic toner at an image section of said photoconductor and collecting said magnetic toner at a non-image section of said photoconductor by said toner collecting electrode roller;

passing transfer paper between said photoconductor and a conductive elastic roller which is in contact with said photoconductor, and transferring said magnetic toner from said photoconductor to said transfer paper by transfer bias voltage applied to said conductive elastic roller;

removing residual magnetic toner left on said photoconductor in said transferring step; and recycling said residual magnetic toner in said developing step.

27. The electrophotographic method as in claim 26, wherein the conductive elastic roller used in the transferring step comprises a urethane foaming material, to which a conductive additive is added, as an elastic member.

28. The electrophotographic method as in claim 27, wherein the conductive additive is lithium salt.

29. The electrophotographic method as in claim 26, wherein the cleaning is carried out with an elastic urethane blade.

30. The electrophotographic method as in claim 26, wherein the cleaning is carried out with a bias-applied fur brush.

31. The electrophotographic method as in claim 26, wherein the cleaning is carried out with a bias-applied conductive metallic roller.

* * * * *